United States Patent [19]

Brunner

[11] 4,381,735

[45] May 3, 1983

[54] CRADLE SYSTEM FOR A STEAM GENERATOR

[75] Inventor: Alfred Brunner, Winterthur, Switzerland

[73] Assignee: Sulzer Brothers Limited, Winterthur, Switzerland

[21] Appl. No.: 297,044

[22] Filed: Aug. 27, 1981

[30] Foreign Application Priority Data

Aug. 29, 1980 [CH] Switzerland ..... 6507/80

[51] Int. Cl.[3] ..... F22B 37/24

[52] U.S. Cl. ..... 122/510

[58] Field of Search ..... 122/510, 493; 165/162, 165/172

[56] References Cited

U.S. PATENT DOCUMENTS 3,301,225 1/1967 Boe et al. ..... 122/510
3,357,408 12/1967 Patterson ..... 122/510
3,461,847 8/1969 Jacobs et al. ..... 122/510
3,467,068 9/1969 Brunner ..... 122/510
4,136,736 1/1979 Small ..... 122/510 X

*Primary Examiner*—Edward G. Favors
*Attorney, Agent, or Firm*—Kenyon & Kenyon

[57] ABSTRACT

A cradle system for a steam generator having four flat diaphragm walls at right-angles to one another comprises a number of cradles. Each cradle has flexural members extending over a portion of the generator periphery which are connected to the diaphragm walls by pressure elements. The construction of the flexural members differs from one cradle to the next.

The differences between the construction of successive cradles improve the resistance of the generator to earthquakes, in that forces acting diagonally on the generator are converted into bending loads, which are distributed over large regions of the diaphragm walls.

11 Claims, 10 Drawing Figures

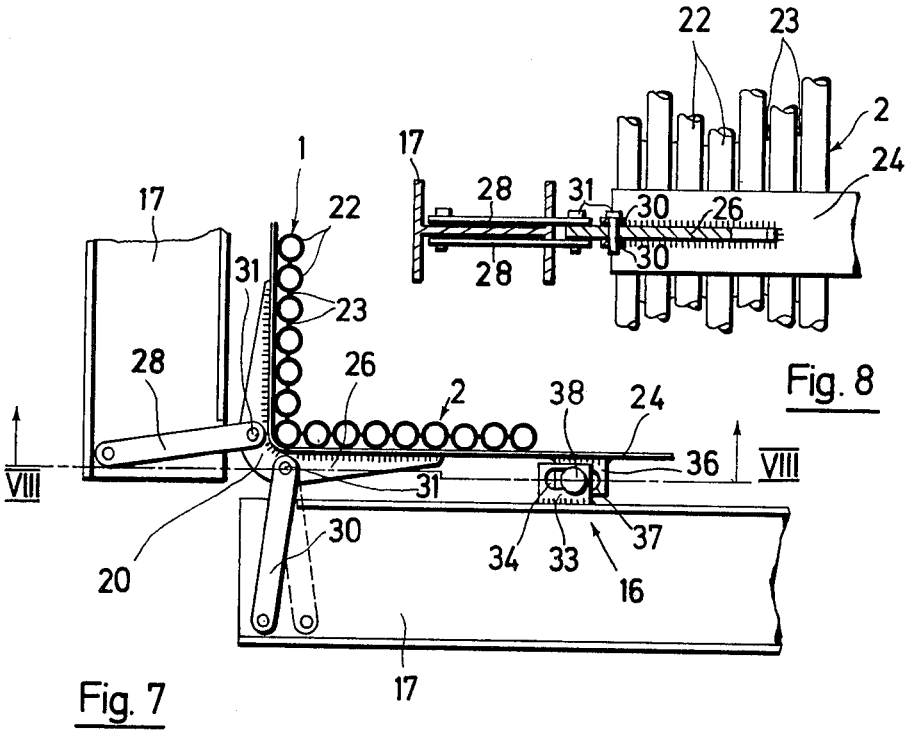
Fig. 7
Fig. 8
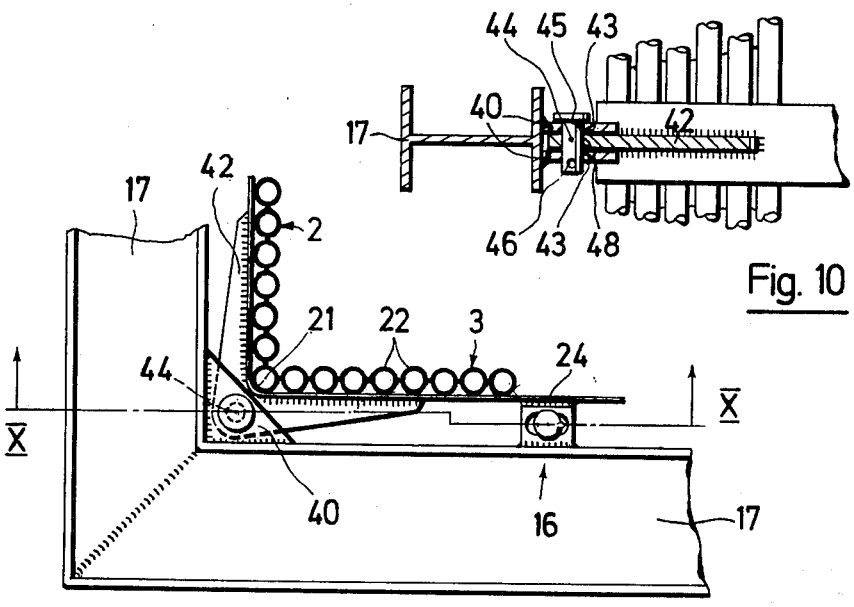
Fig. 9
Fig. 10

CRADLE SYSTEM FOR A STEAM GENERATOR

This invention relates to a cradle or buckstay system for a steam generator, particularly a steam generator of rectangular cross-section.

As is known, steam generators of rectangular construction having flat diaphragm walls disposed at right angles to each other have frequently been provided with a cradle or buckstay system for the support of the walls. Generally, the cradle system comprises a multiplicity of cradles which surround the steam generator and which are distributed along the length of the generator. In addition, each cradle has been made up of a number of flexural members which extend around a portion of the generator periphery to allow motion relative to the diaphragm walls. These flexural members are, in turn, connected to the diaphragm walls by pressure elements located in spaced apart relation along the length of the flexural members. For example, as described in German Auslegesschrift No. 19 59 800, all the cradles for the generator are constructed in an identical manner. Each cradle comprises four right-angled flexural members having limbs of unequal lengths with the junctions between the flexural members located at places where the bending moments in the diaphragm walls disappear. These individual flexural members are interconnected by self-locking gears or drives so that the diaphragm walls can be relieved of tensile stresses.

However, cradle systems which are made up entirely of straight flexural members or of right-angled flexural members as described in the German A.S. have the disadvantage that in the event of substantially diagonal oscillation, for example caused by earthquakes, the diaphragm walls are subjected to considerable bending stresses at the joints between the flexural members. In some cases, it has been known to dissipate diagonal forces via shock-absorbing elements to the generator frame. However, such shock-absorbing elements are disadvantageous because they are relatively expensive and the generator frame has to be strengthened to prevent buckling. Further, the shock-absorbing elements may also jam, for example due to corrosion. It is also known to couple the flexural members inside a cradle via connecting elements which permit relative motion but are flexurally rigid. While this method may be successful, such is relatively expensive.

Accordingly, it is an object of the invention to dissipate bending stresses caused by a diagonal oscillation on a steam generator in a relatively inexpensive manner.

It is another object of the invention to reduce the bending stresses caused by a diagonal oscillation in a steam generator having diaphragm walls.

It is another object of the invention to provide a cradle system for a steam generator which can be easily fabricated and installed.

Briefly, the invention provides a cradle system for a steam generator having four upstanding flat diaphragm walls disposed at right angles to each other. The cradle system includes a plurality of cradles which encompass a periphery of the generator and which are spaced longitudinally along the generator for supporting the diaphragm walls. Each cradle includes a plurality of flexural members disposed in spaced relation to each other around the generator to define a gap between each pair of adjacent members. In addition, the flexural members of the cradles are disposed with the gaps of successive cradles offset from each other at the periphery of the generator.

In addition, the cradle system includes a plurality of spaced apart pressure elements securing each flexural member to at least one of the diaphragm walls of the generator.

In accordance with the invention, either the construction of the successive cradles is different or the arrangements of the flexural members in the successive cradles is different, or both. In this way, in the event of a diagonal oscillation, the forces which are generated and which operate substantially in the diagonal direction of the generator are converted into bending loads which are uniformly distributed over large regions of the diaphragm walls and are correspondingly lower than in the known cradle systems. The cradle system thus eliminates any unacceptable stresses, even locally, without requiring new structural elements or considerable structural reinforcement.

In one embodiment, the alternating cradles each include four straight flexural members. In this case, each flexural member is of a length equal to the width of a peripheral wall while the remaining cradles include at least one right-angled flexural member.

In another embodiment, each alternating cradle includes four right-angled flexural members. In this embodiment, each flexural member has limbs which are of less length than the width of a wall of the steam generator.

In still another embodiment, the alternating cradles have two right-angled flexural members. In this embodiment, each of the members has limbs of a length at least equal to a width of a respective generator wall.

In still another embodiment, the alternating cradles include two right-angled flexural members and a straight flexural member. In this embodiment, the two right-angled flexural members are disposed about three of the walls of the generator while the remaining straight flexural member is disposed along the fourth wall.

In still another embodiment, the alternating cradles include one right-angled flexural member and two straight flexural members. In this case, the straight members are located along respective walls of the generator while the right-angled member is located along two adjacent walls of the generator.

The various types of cradles can be disposed in alternating patterns with respect to each other.

Advantageously, where straight flexural members are used, the cradles are very economic to manufacture, transport and assemble.

These and other objects and advantages of the invention will become more apparent from the following detailed description taken in conjunction with the drawings wherein:

FIG. 7 illustrates a joint between two adjacent diaphram walls and a junction between two flexural members in accordance with the invention;

FIG. 8 illustrates a view taken on line VIII—VIII of FIG. 7;

FIG. 9 illustrates a view similar to FIG. 7 but at the corner of a right-angled flexural member; and FIG. 10 illustrates a view taken on line X—X of FIG. 9.

Figure 1:
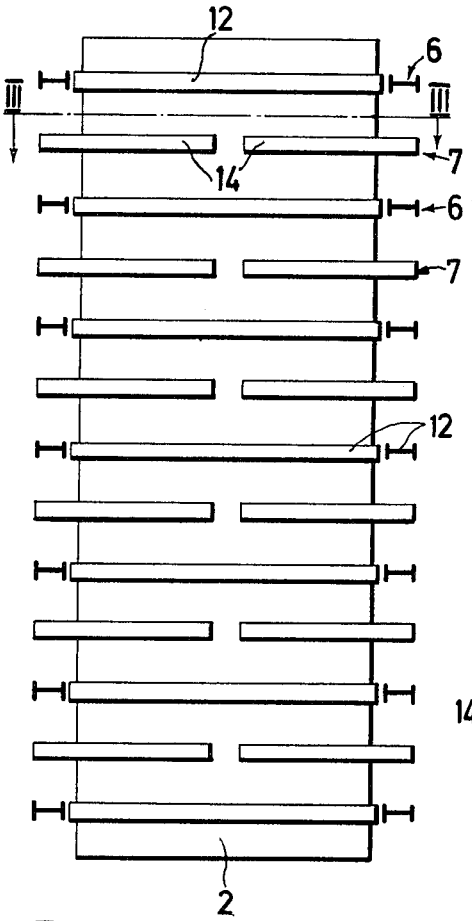
FIG. 1 illustrates a view of a steam generator utilizing a cradle system according to the invention.
Figure 2:
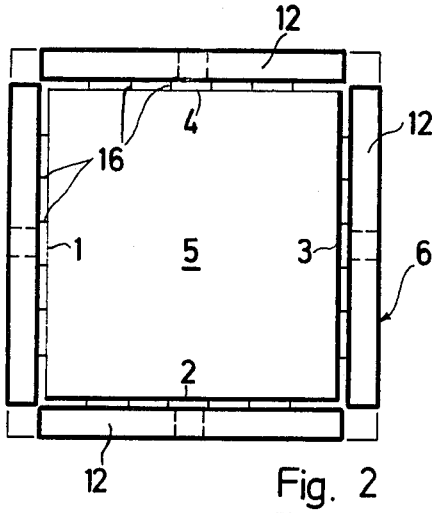
FIG. 2 is a plan view of the steam generator of FIG. 1 illustrating one form of cradle.

Referring to FIG. 1, the steam generator is constructed of four upstanding flat diaphragm walls 1, 2, 3, 4 which are disposed at right angles to each other to define a vertical duct 5. As indicated in FIG. 2, the duct 5 has a rectangular cross-section and the walls are of equal dimensions. The lower end of the duct 5 may merge into a reinforced base (not shown) while the upper end can be located adjacent to a chimney.

As indicated in FIG. 1, a cradle system supports the generator walls 1–4. This cradle system includes a plurality of cradles 6, 7, (e.g. thirteen) which encompass the periphery of the generator. The cradles 6, 7 are spaced longitudinally along the generator and are each comprised of a plurality of flexural members which are disposed in spaced relation to each other.

Figure 3:
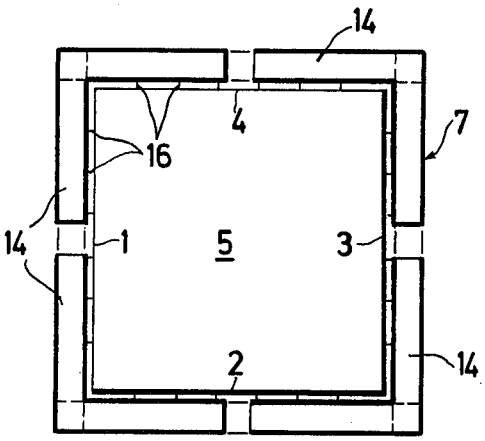
FIG. 3 illustrates a view taken on line III—III of FIG. 1 and illustrating an alternating cradle in accordance with the invention.

As shown in FIG. 2, alternating cradles 6 comprise four straight flexural members 12 while, as shown in FIGS. 3, the other cradles 7, comprise four right-angled flexural members 14. As indicated in FIGS. 2 and 3, the flexural members 12, 14 are spaced apart to define a gap between each pair of adjacent members 12, 14, respectively. In addition, the flexural members of the respective cradles 6, 7 are disposed with the gaps of successive cradles 6, 7 offset from each other at the periphery of the generator. The term "flexural member" means a member which is designed to carry bending moments.

A plurality of spaced apart pressure elements 16 are also distributed along the length of the flexural members, 12, 14 or across the width of the diaphragm walls 1–4 to secure each flexural member 12, 14 to at least one of the diaphragm walls 1–4. When the steam generator is in operation, the pressure elements 16 convey gas pressure forces from the walls 1–4 to the flexural members 12, 14 without applying excessive bending stresses on the walls 1–4. If localised explosions occur, these forces can be many times the normal excess gas pressure in the combustion chamber of the steam generator.

As indicated in FIG. 1, the successive cradles 6, 7 are characterized in that the construction of one cradle is different from the construction of the adjacent cradle or the arrangement of the flexural members in one cradle is different from the arrangement in the adjacent cradle, or both. As FIG. 1 illustrates, the four straight flexural members 12 of the cradles 6 alternate with the four right-angled flexural members 14 of the cradles 7 so that the gaps between the flexural members are offset relative to each other. In this construction, since the walls 1–4 offer some resistance to local bulging out of their plane, the steam generator wall structure is considerably strengthened against diagonal forces by the alternating arrangement of the straight and right-angled flexural members 12, 14. Any stresses resulting from diagonal forces in the diaphragm 1–4 are distributed over the area of the walls 1–4 thus preventing any excessive tension peaks.

Figure 4:
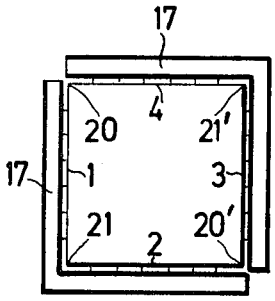
FIG. 4 illustrates a plan view of a cradle employing two right-angled flexural members in accordance with the invention.

Referring to FIG. 4, the alternating cradles may also be comprised of two right-angled flexural members 17 having limbs of approximately the same length as the width of the adjacent diaphragm walls 1–4. A cradle of this kind can be used in place of the cradles 7 of FIG. 1. Alternatively, the entire cradle system of the steam generator can consist of the cradles of FIG. 4 if the flexural members 17 in successive cradles are each offset by 90°. The advantage of the cradles of FIG. 4 is that if explosions occur within the steam generator, the corners of the members 17 can be designed for a smaller bending moment than in the case of the cradles of FIG. 3. In addition, if diagonal stresses occur, there are half way across the diaphragm wall no points of inflection in the bending line of the wall. However, members 17 are heavier and more difficult to handle, and consequently, the limbs of the members 17 have to be rigidly connected at the building site.

Figure 5:
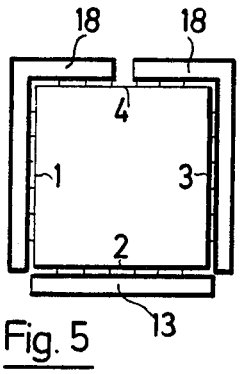
FIG. 5 illustrates a plan view of a cradle employing two right-angled flexural members and a straight flexural member in accordance with the invention.

Referring to FIG. 5, a cradle may be constructed of two right-angled flexural members 18 and a straight flexural member 13. As indicated, the right-angled members 18 each have a short limb and a long limb to support three diaphragm walls 1–3 whereas the straight flexural member 13 supports the fourth diaphragm wall 14. This cradle may be used in alternation with the cradle 6 of FIG. 2 or can be used exclusively if, in adjacent planes, the short limbs of the two members 18 alternately abut the diaphragm wall 2 and the diaphragm wall 4. Alternatively, the short limbs of the two flexural members 18 may abut the four diaphragms walls 1–4 sequentially in successive planes.

Of note, allowance can be made for the placement of burners, inspection holes, braces for insulation, pipes and the like.

Figure 6:
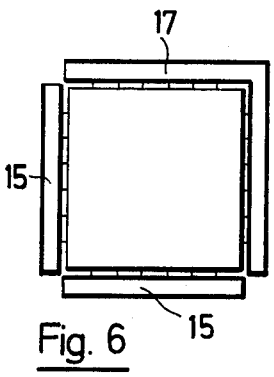
FIG. 6 illustrates a cradle employing a single right-angled flexural member and two straight flexural members in accordance with the invention.

Referring to FIG. 6, a cradle may be comprised of a single right-angle flexural member 17 and two straight flexural members 15. As indicated, the flexural member 17 has limbs which extend all the way across the adjacent diaphragm wall so that each limb is at least equal to the width of a wall. This cradle may also alternate with the cradles of FIG. 2 or with similar or different cradles as illustrated. Preferably, care is taken that the junctions or gaps between the flexural members of successive cradles are each offset from one another at the periphery of the steam generator.

Referring to FIGS. 7 and 8, the diaphragm walls 1–4 are of similar construction with each comprising a plurality of vertical pipes 22 interconnected in gas-tight manner via webs 23. In order to support the flexural members, each pressure element 16 is constructed of a U-section member 33 welded to the flexure member 17 and having an elongated aperture 34 and a flat section member 36 welded to a tie member 24 which, in turn, is welded to the pipes 22 at the outside of the wall at the same height as the flexural member 17. The flat section member 36 has an elongated aperture 37 and projects between the two limbs of the U-member 33 (FIG. 8) so that the apertures 34, 37 overlap. In addition, a bolt 38 passes through the apertures. This bolt 38 has a head at the top end and, if required, a cotter pin at the bottom end. The pressure element 16 may also receive certain tensile forces and has sufficient clearance for the bolt 38 to roll easily in the apertures 34, 37.

In addition, a boomerang-shaped lug 26 is welded to the tie member 24 near a junction 20 of the walls 1, 2. This lug 26 has two bores in which respective pins 31 are disposed. Each pin 31 also engages a respective pair of links 28, 30 at one end while the other ends of the pairs of links 28, 30 are pivotally mounted in the adjacent ends of the flexure member 17. As indicated in FIG. 7, each of the bores in the lug 26 is in line with one of the rows of tubes of the walls 1, 2. Alternatively, the bores may be disposed in line with the sides of the tie members 24 or only one bore may be provided which must then lie on a line at 45° through the junction 20.

The pairs of links 28, 30 form tension elements for securing the flexural members 17 to the walls 1, 2. A connection similar to that shown in FIG. 7 also occurs at the diametrically opposite edge 20' at the walls 3, 4.

If, as a result of differences in temperature, differences in expansion occur between the diaphragm walls and the adjacent flexural members 17, the pairs of links 28, 30 will move at an angle as indicated in FIG. 7 by continuous and chain-dotted lines for the two end positions of the links 30. Since the links 28, 30 are made as long as possible, the oblique position does not have any appreciable effect on the distance between the member 17 and the adjacent diaphragm wall.

Referring to FIGS. 9 and 10 which show the corner part of a right-angled flexural member 17 of FIG. 4 near an edge 21, the flexural member 17 is formed of two I-members welded together to form a right angle. In addition, two triangular lugs 40 are disposed in parallel to the plane of the member 17 and are welded to the inside of the angle formed by the I-members (see FIG. 10). Also, a boomerang shaped lug 42 is welded on the tie member 24 in the neighborhood of the edge or joint 21 to engage between the two lugs 40. As indicated, the lugs 40 have respective bores 43 while the lug 42 has a bore 48 in alignment with the bores 43. A bolt 44 passes through the aligned bores 43, 48 and is prevented from falling out by a head 45. As above, the bolt 44 can be secured by a cotter pin (not shown) for which purpose a bore 46 (see FIG. 10) is provided. The corner of the other flexural member 17 (FIG. 4) at the diagonally located edge or joint 21' is connected in a similar manner. As shown in FIG. 9, the pressure element 16 located near the corner of the flexural member 17 is substantially in a center position because the motion of the wall 3 relative to the adjacent flexural member 17 is very small near the corner of the flexural member 17.

It is to be noted that in addition to the illustrated embodiments, there are a number of further possible embodiments. For example, the cross-section of the duct 5 of the steam generator may be of a rectangular shape other than a square. Also, pivotally mounted stanchions may be used as the pressure elements 16. Also, the tie member 24 may bear directly on the flexural members.

The invention thus provides a cradle system which can be used to support a steam generator against the stresses occurring due to a diagonal oscillation. Further, the cradle system can be made of relatively simple parts and can be assembled in a minimum of time.

What is claimed is:

1. In combination a steam generator having four upstanding flat diaphragm walls disposed at right angles to each other;

a plurality of cradles encompassing a periphery of said generator and being spaced longitudinally along said generator for supporting said walls, each said cradle including a plurality of flexural members disposed in spaced relation to each other around said generator to define a gap between each pair of adjacent members, said members of said cradles being disposed with at least one gap of a cradle is, offset from the gaps of an adjacent cradle; and a plurality of spaced apart pressure elements securing each flexural member to at least one of said diaphragm walls.

2. The combination as set forth in claim 1 wherein alternating cradles each include four straight flexural members.

3. The combination as set forth in claim 4 wherein alternating cradles each include four right-angled flexural members.

4. The combination as set forth in claim 1 wherein alternating cradles each include two right-angled flexural members, each right-angled member having limbs of a length at least equal to a width of a respective generator wall.

5. The combination as set forth in claim 1 wherein alternating cradles each include two right-angled flexural members and a straight flexural member.

6. The combination as set forth in claim 1 wherein alternating cradles each include one right-angled flexural member and two straight flexural members.

7. The combination as set forth in claim 1 wherein said pressure elements transmit tensile forces between said flexural members of said walls.

8. The combination as set forth in claim 1 which further comprises tension elements connecting said walls to said flexural members near each junction of two adjacent walls.

9. The combination as set forth in claim 1 wherein each cradle comprises two right angled flexural members each having limbs of a length at least equal to a width of a respective generator wall.

10. The combination as set forth in claim 1 wherein each cradle includes two right-angled flexural members and a straight flexural member.

11. In combination a steam generator having four upstanding flat diaphragm walls disposed at right angles to each other;

a plurality of cradles encompassing a periphery of said generator and being spaced longitudinally along said generator for supporting said walls, each said cradle including a plurality of flexural members disposed in spaced relation to each other around said generator to define a gap between each pair of adjacent members and successive cradles being disposed in pairs with at least one gap of one cradle of said pair of cradles being offset from the gaps of an adjacent cradle of said pair of cradles; and a plurality of spaced apart pressure elements securing each flexural member to at least one of said diaphragm walls.

* * * * *